US006119775A

United States Patent [19]

Drechsler et al.

[11] Patent Number: 6,119,775

[45] Date of Patent: Sep. 19, 2000

[54] INFLATABLE DOWNHOLE SEAL

[75] Inventors: Jan Drechsler, Hafrsfjord; Tom Unsgaard, Stavanger, both of Norway

[73] Assignee: Weatherford/Lamb, Inc.

[21] Appl. No.: 09/214,996

[22] PCT Filed: Feb. 3, 1998

[86] PCT No.: PCT/NO98/00037

§ 371 Date: Nov. 9, 1999

§ 102(e) Date: Nov. 9, 1999

[87] PCT Pub. No.: WO98/36152

PCT Pub. Date: Aug. 20, 1998

[30] Foreign Application Priority Data

Feb. 14, 1997 [NO] Norway ..... 970671

[51] Int. Cl.[7] ..... E21B 33/127

[52] U.S. Cl. ..... 166/187; 188/192

[58] Field of Search ..... 166/192, 195, 166/187, 126, 131, 133, 149, 142

[56] References Cited

U.S. PATENT DOCUMENTS

| | | | |
|---|---|---|---|
| 2,187,635 | 1/1940 | Stamps . | |
| 2,342,884 | 2/1944 | Moore . | |
| 2,828,823 | 4/1958 | Mounce . | |
| 2,997,107 | 8/1961 | Lynes . | |
| 3,044,553 | 7/1962 | Bradley . | |
| 3,085,628 | 4/1963 | Valone . | |
| 3,436,084 | 4/1969 | Courter . | |
| 3,437,142 | 4/1969 | Conover . | |
| 3,464,709 | 9/1969 | Furgason et al. | 277/233 |
| 3,542,127 | 11/1970 | Malone | 166/122 |
| 3,706,342 | 12/1972 | Woolley | 166/134 |
| 4,008,759 | 2/1977 | Blackwell | 166/120 |
| 4,043,390 | 8/1977 | Glotin | 166/215 |
| 4,224,987 | 9/1980 | Alllen | 166/120 |
| 4,299,397 | 11/1981 | Baker et al. | 166/120 |
| 4,316,504 | 2/1982 | Baker et al. | 166/53 |
| 4,421,165 | 12/1983 | Szarka | 166/151 |
| 4,467,867 | 8/1984 | Baker . | |
| 4,492,383 | 1/1985 | Wood | 277/34 |
| 4,655,262 | 4/1987 | Halbardier . | |
| 4,708,208 | 11/1987 | Halbardier | 166/387 |
| 4,840,231 | 6/1989 | Berzin et al. | 166/387 |
| 5,046,557 | 9/1991 | Manderscheid . | |
| 5,297,634 | 3/1994 | Loughlin | 166/387 |
| 5,404,946 | 4/1995 | Hess | 166/187 |
| 5,718,292 | 2/1998 | Heathman et al. | 166/387 |
| 5,720,343 | 2/1998 | Kilgore et al. | 166/120 |

FOREIGN PATENT DOCUMENTS

| | | |
|---|---|---|
| 0 290 114 | 11/1988 | European Pat. Off. . |
| 2 308 138 | 11/1996 | United Kingdom . |

*Primary Examiner*—Frank Tsay
*Attorney, Agent, or Firm*—Guy McClung

[57] ABSTRACT

A sealing apparatus for use in a well in connection with oil or gas production includes a seal and a pressure compensator. The seal is an inflatable, balloon-type well seal. The seal has a first cavity and is bears against an inner surface of a tubular surface. The pressure compensator is associated with the seal and includes a cylinder having a second cavity. The second cavity is in fluid communication with the first cavity. The cylinder has a reciprocatingly slidable piston positioned therein. The piston has first and second piston surfaces of different areas at opposite sides of the piston. The first piston surface is exposed to a first pressure value within the first cavity and the second piston surface is exposed to a second pressure value within the well. The pressure compensator regulates, depending on a difference in the areas of the first and second piston surfaces, the first pressure value within the first cavity of the inflated well seal depending on the second pressure value effective downstream of the seal. The second pressure value constitutes a reference pressure value for the first cavity of the seal.

6 Claims, 5 Drawing Sheets

INFLATABLE DOWNHOLE SEAL

FIELD OF THE INVENTION

The present invention relates to an inflatable seal for use in a well in connection with production of oil and gas.

BACKGROUND OF THE INVENTION

Such downhole seals are of a balloon type and the inflating medium is liquid. Downhole seals of this kind have been used for a number of years.

In inflated condition they serve as plugs in the well bore, and in one application case they may prevent the passing of undesired fluid, e.g. water, which is produced in a zone of the formation beneath an oil and/or gas-producing formation zone. In such a case a downhole seal will be placed immediately above the upper boundary layer of the water-producing formation zone.

In another application case two spaced-apart inflatable downhole seals are used, and here too the seals prevent undesired fluid (water) from passing, but in this case it is sought to exploit oil and/or gas of a formation beneath the water-producing zone. In such a case there may also exist an oil-producing formation zone above the water-producing zone.

In the latter case, a pipe connection is established leading through the lower inflated seal, through the well bore section between the seals, in which water is being produced, and through the upper inflated seal. Oil/gas in the formation zone beneath the water-producing zone is thus transported through the lower seal, then through the pipe connecting the seals and eventually through and out of the upper seal, this oil/gas not having been in contact with the water in the zone located between the seals.

In the following description the invention will be explained in connection with vertical well bores, and the terms "above" and "below" will then be easily understood. In deviated wells and horizontal wells "above" means "closer to the well head" and "below" means "further from the well head". Of course, inflatable balloon type seals according to the invention are not limited to application in well bores of a particular orientation, but may be used in vertical well bores, deviated wells, extended reach wells and horizontal wells.

When the seal(s) is (are) in the inflated condition in a well bore with its (their) circumferential portion bearing in a tightening manner against the formation wall, temperature changes in the environment immediately adjacent the well bore will give rise to internal pressure changes in the inflated seals. By high temperature developing in the well bore area, in which the inflated seal forms a plug, it happens that the seal bursts in the same way as an inflated balloon. By low temperature, the bearing and tightening pressure of the seal on the wall of the well bore is reduced, and it therefore happens that the seal loosens.

It is known to precondition wells before such seals are set, so that the seals may be set at a temperature which is considered to be normal operating temperature. Preconditioning of a well is done by regulating the flow rate (production rate or injection rate) of the well and is time consuming, expensive and uncertain as to the result.

Likewise, it is known to fill the seal with curable materials—cement mixture or liquid, subsequently setting epoxy resin composition—instead of a liquid inflating medium which remains in its liquid form. A disadvantage of a hard, firm plug-like seal is that it is not that easily removed. Indeed, it may be drilled to pieces, but that is an expensive operation.

SUMMARY OF THE INVENTION

The object of the present invention has, therefore, been to provide an inflatable downhole seal, which, without the use of a curable inflating medium, will be able to resist high and low temperatures and great temperature variations in its operating environment, without being broken or loosen in its tightening, bearing pressure against the surrounding formation wall.

It is aimed at providing two main embodiments, one for each of the two initially mentioned typical application cases. One embodiment has the exclusive task of blocking the well above a formation zone which produces an undesired fluid. The other embodiment additionally allows the exploitation of fluid of a formation zone located below a zone producing undesired fluid. In the latter case two seals are used, one above and one below the formation zone producing the undesired fluid.

Said aim is essentially reached by means of inflatable downhole seals which which is an inflatable well seal of the balloon type that is in fluid communication by a cavity 10' with a cavity of a cylinder. The seal has a piston with a first piston surface which is influenced by the pressure inside the cavity of the well seal. A second piston surface faces the opposite direction and is influenced by the pressure in the well. The two piston surfaces have mutually different areas. The pressure compensator is arranged to regulate, on the basis of this difference in piston surface area, the internal pressure in the inflated well seal in relation to the ambient pressure (well pressure) effective downstream of the seal and thus constituting a reference pressure for the internal pressure of the seal.

An inflatable downhole seal of the kind in question is characterized in principle by being provided with a pressure compensator, for example of the piston type, which utilizes the reservoir pressure as reference value.

On its underside, the inflatable seal has an axially projecting pipe connection which engages a socket element, whose lower part encloses a solid, central body, through which extends at least one through channel from the interior of the inflated seal, opening into the area of the first (upper) piston surface of an upper piston comprised by an axially displaceable piston device, which further comprises a lower piston with a second (downward facing) piston surface. The two pistons are connected to each other in a mutually non-displaceable manner through a central piston rod. For the upper piston of the piston device is provided an upper cylindrical housing, and for the lower piston a lower cylindrical housing, which cylindrical housings are joined by adjacent end portions and sealed, one against the other. Said lower cylindrical housing has a lower end, which may have a downward tapering conical form with an end opening, establishing fluid communication between the cylinder chamber and the downward-facing piston surface of the lower piston and the surrounding environment, to let this piston surface be influenced by the pressure in the well.

By sizing the area of the upward-facing end surface of the piston, affected by the internal liquid pressure of the inflated seal, in a determined proportion (for example 1:6) to the area of the downward-facing end surface of the piston, the piston device will work as a pressure compensator for the inflated downhole seal. The pressure compensating piston device will absorb or reduce the effect of the cooling or heating of the liquid inside the seal. This is achieved by utilizing the pressure below the seal and the effect of the areas of the piston surfaces facing opposite directions. By a piston area proportion of 1:6 the pressure will be equalized if the reservoir pressure below the seal is six times higher than the liquid pressure inside the seal. The liquid pressure of the inflated seal thus acts against the end surface of said upper piston, and the reservoir pressure against the end surface of said lower piston, facing the opposite direction.

The pressure inside the seal will thus relate to the pressure in the well as the proportion of the areas of the piston surfaces facing opposite directions.

BRIEF DESCRIPTION OF THE DRAWINGS

In the following, reference is made to a non-limiting example of an embodiment illustrated in the accompanying drawings, in which FIGS. 1–3 show a first embodiment of the invention, whereas FIGS. 4 and 5 show another embodiment of the invention, and in which:

FIG. 1 shows in a side view a downhole seal inflated and thus fixed in a tubing, the tubing and the down-hanging pressure compensator of the downhole seal being shown in an axial view;

FIG. 2 shows, in an axial view and on a somewhat larger scale than in FIG. 1, the lower portion of FIG. 1;

FIG. 3 corresponds to FIG. 2, but here the piston device has been displaced somewhat upwards compared to FIG. 2;

FIG. 4 shows a corresponding axial sectional view of a second embodiment, in which provision has been made for the transfer of a desired fluid through the seal and pressure compensator, the shown seal co-operating in practice with an identical seal set there below;

FIG. 5 corresponds to FIG. 4, but shows the piston device, which here and in FIG. 4 comprises one annular piston formed on the outside of a central, tubular piston rod, displaced upwards, so that it adopts another position of axial displacement than that in FIG. 4.

DETAILED DESCRIPTION OF THE INVENTION

Figure 1:
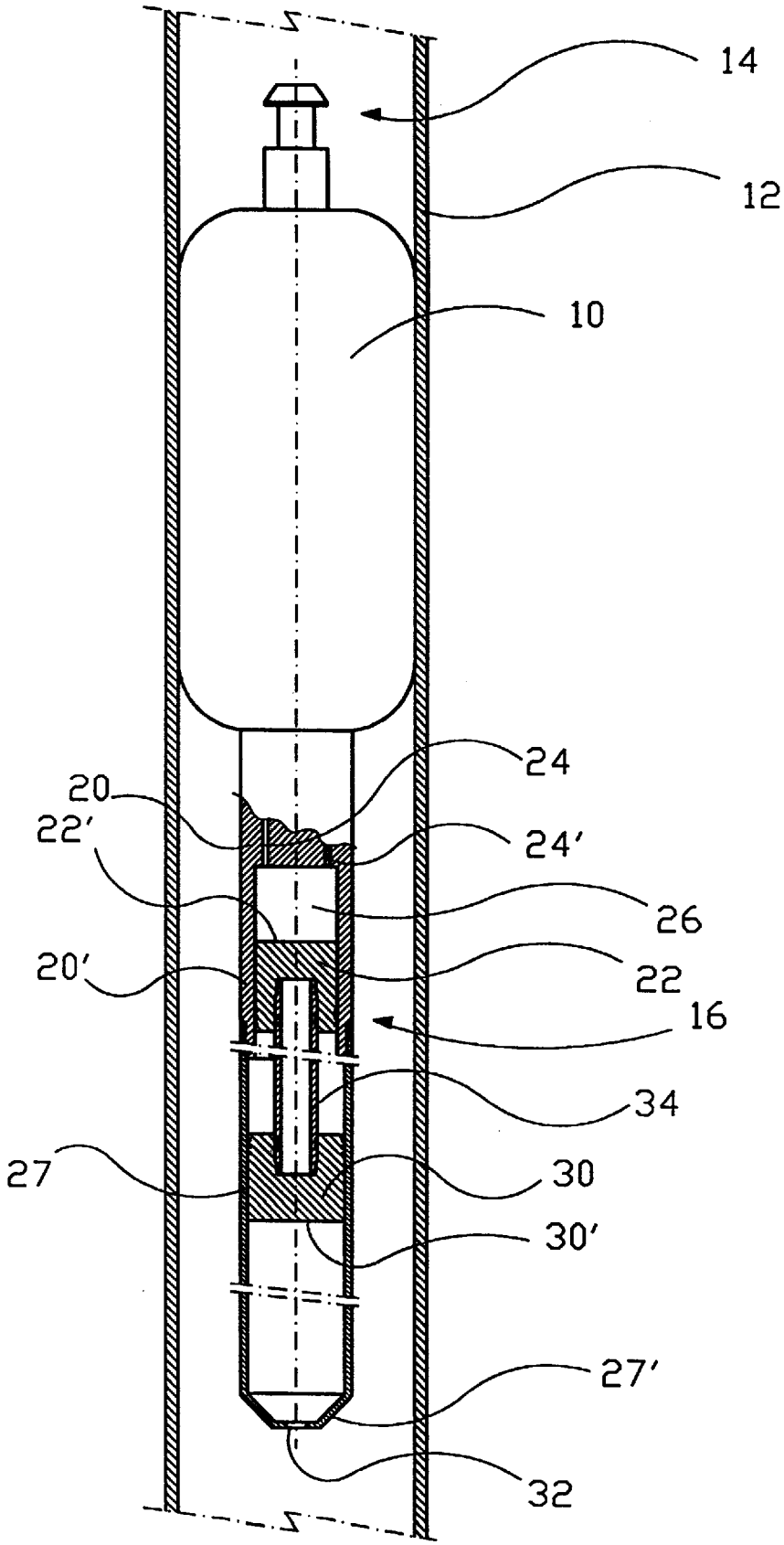
Figure 2:
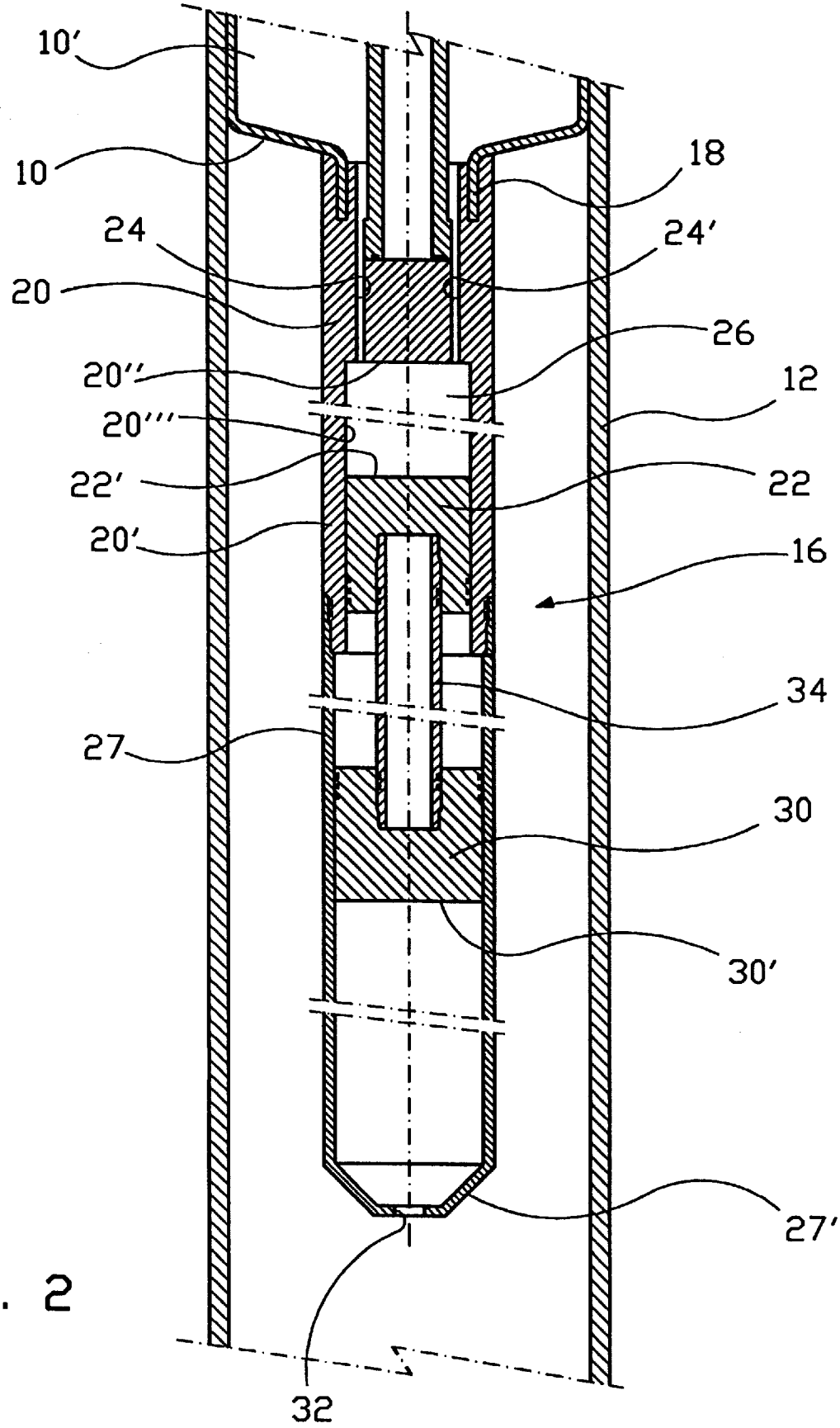
Figure 3:
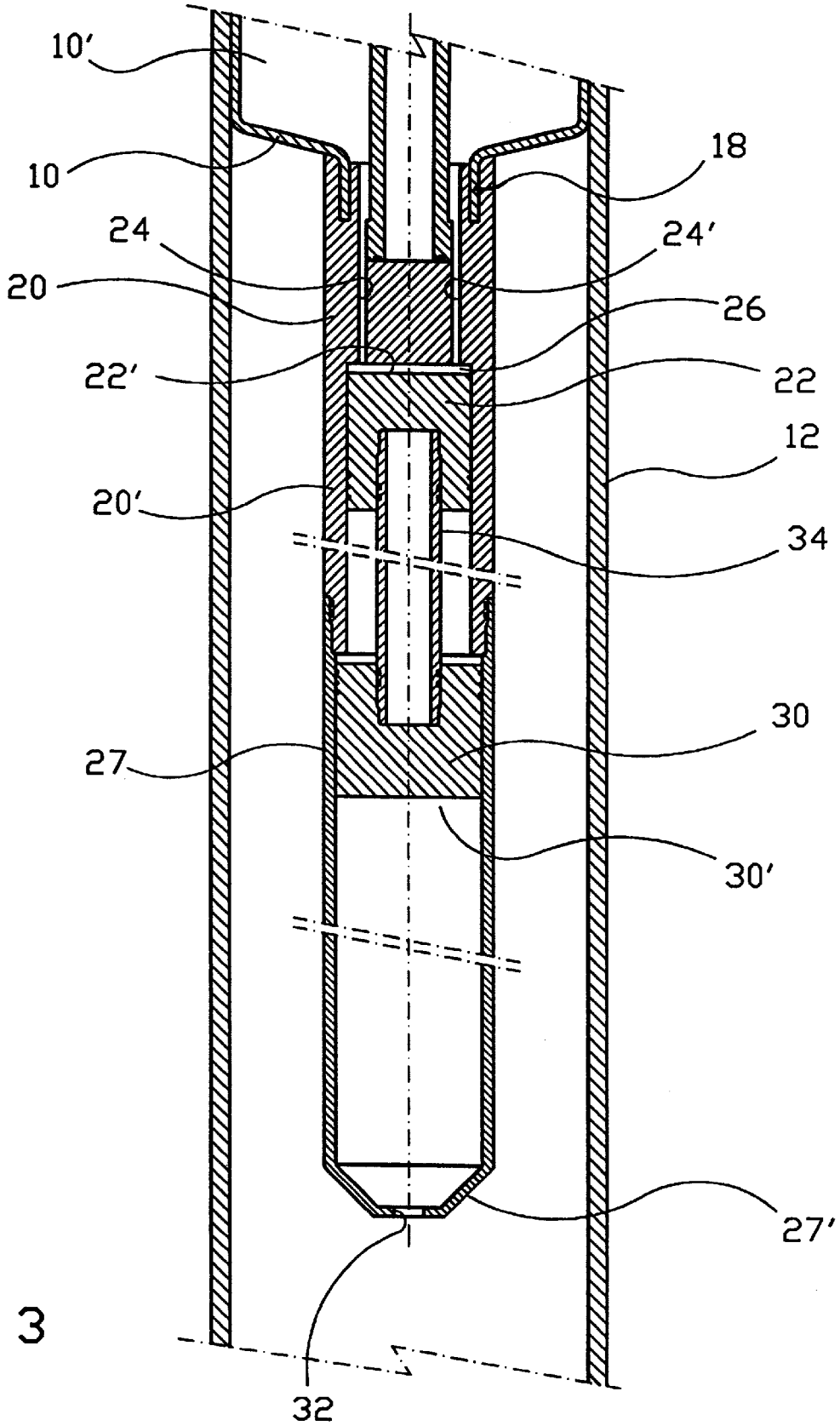

First, reference is made to FIGS. 1–3 which show an inflatable downhole seal 10, which in a manner known in itself, has been inflated with a suitable liquid and set in a particular place inside a tubing 12, against which the inflated seal 10 has established and maintains absolute tightness across the total internal cross section of the tubing 12. The seal 10 may be set for example above a formation zone that produces water or other undesired fluid.

Uppermost the set downhole seal 10 has a bottle neck 14, FIG. 1, and lowermost a pressure compensator which is generally defined by the reference numeral 16.

The lower end of the downhole seal 10 is formed as a downward pipe socket 18, FIGS. 2 and 3, which has also been screwed in a tightening manner to the top of an upper cylinder housing 20. This housing 20 accommodates an upper piston 22 displaceable upwards and downwards.

In its upper portion the upper cylinder housing 20 has two or more axial channels 24, 24' formed therein and extending therethrough, which, by their upper ends, are in liquid communication with the cavity 10' of the inflated seal 10, and, by their lower ends, open into a chamber 26 defined by a downward-facing end surface 20" by the cavity of the upper cylinder housing 20, the opposite, upward facing end surface 22' of a first piston 22, and a portion of the internal cylinder surface 20'" of the upper cylinder housing 20. The upper piston end surface 22' is influenced by the liquid pressure inside the seal 10.

The cylinder housing portion 20' of the upper cylinder housing 20 for the first piston 22 is screwed, by its lower end, firmly and tighteningly to the upper end of a lower cylinder housing 27, which has a larger internal cross-sectional area than the cylinder housing portion 20' of the upper cylinder housing 20.

The lower cylinder housing 27 receives a second, lower reciprocatingly displaceable piston 30. The lower downward conically tapering end 27' of the cylinder housing 27 is provided with a central opening 32, so that the downward end surface 30' of the lower piston 30 is continuously influenced by the pressure in the well, without the cylinder liquid being in contact with the well fluid.

The end surface 30' of the piston 30 has a substantially lager surface area than that of the end surface 22' of the piston 22. For example the piston surface 30' may have a piston surface 6 times larger than the piston surface 22'. These pistons 22 and 30 are non-displaceably connected to each other by means of a central piston rod 34.

Thus, a pressure compensation has been provided in the form of a piston device, which comprises, among other things, the pistons 22, 30 and the tubular piston rod 34 connecting the pistons 22, 30 in a mutually non-displaceable manner, and which is based on two opposite piston end surfaces 22', 30' of differently sized areas, and which utilizes the reservoir pressure as reference pressure value.

This piston-based pressure compensator working with the reservoir pressure as the reference pressure, absorbs or reduces the effect of cooling or heating of the inflating liquid of the downhole seal. As mentioned, this happens through utilization of the pressure below the seal (the reservoir pressure).

An inflatable downhole seal with connected pressure compensator is adapted to the individual well. One application case is when, for example, water is to be injected into the formation above a point desired to be plugged by a downhole seal 10, so as to thereby drive out oil or gas.

In such a case the injection water will cool the seal 10, so that its internal pressure is reduced. By such a reduction in pressure there is the risk that the seal 10 may loosen. In the opposite case the seal 10 may be so heated by the ambient temperature in the well, that there is the risk that the seal may burst. Referring to FIG. 3, the seal is inflated by liquid or gaseous inflating medium, so that through the channels 24, 24' liquid or gas will, likewise, flow into the chamber 26, which may be of a considerable longitudinal extension. The pressure on the underside of the seal 10 is known, and remains essentially constant. By decreasing internal liquid/gas pressure in the inflated seal 10, the pressure on the underside of the seal 10 (the reservoir pressure) will force additional liquid/gas from the chamber 26 into the internal cavity 10' of the seal 10, to substantially maintain the original pressure. By the internal liquid/gas pressure in the seal 10 rising to exceed normal pressure, additional liquid or other inflating medium from the interior 10' of the seal 10 will be forced out into the chamber 26 until the pressure is equalized.

Figure 4:
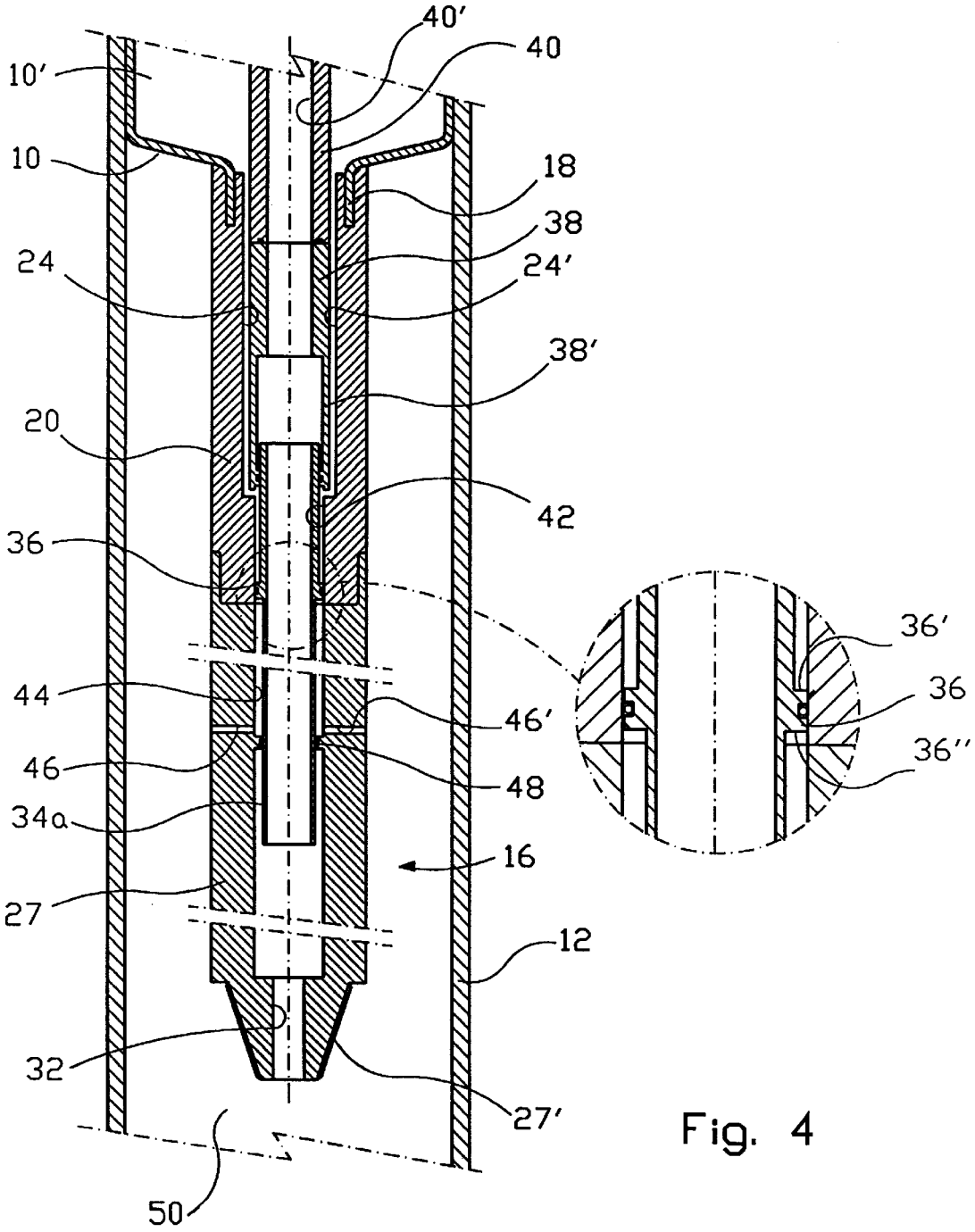
Figure 5:
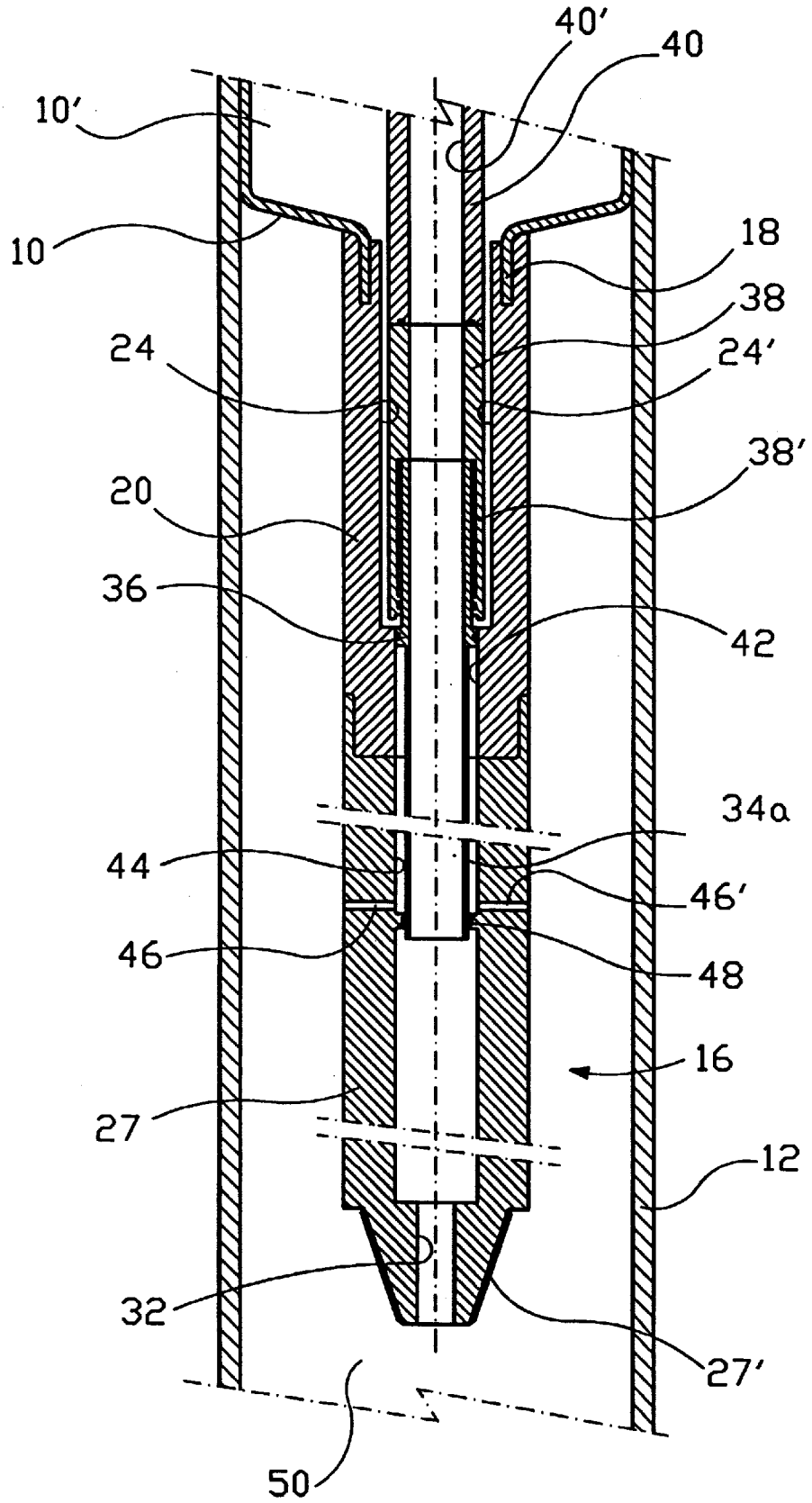

Reference is now made to the embodiment according to FIGS. 4 and 5, which is different from the described embodiment according to FIGS. 1–3 only in (a) the configuration of the piston device, (b) a central through passage for the transportation of desired fluid (oil) from an underlying formation zone through an abovelying formation zone producing undesired fluid (water) , and (c) the use of two opposite downhole seals (only one of these identical seals is shown) axially spaced.

In this second embodiment the central, tubular piston rod 34*a* is formed with an annular piston 36 having a first piston surface 36' which faces an inflated seal 10, and which has a considerably smaller surface area than a second piston surface 36" which faces the free end 27' of the pressure compensator 16. The surface area proportion may for example be 1:6, such as in the first embodiment, FIGS. 1–3.

According to FIGS. 4 and 5 the upper end portion of the central, tubular piston rod 34*a* is in axially displaceable engagement with a lower tube section 38' of a concentric inner tube 38 of the first piston of the upper cylinder housing 20, said inner tube 38 being connected end-to-end to a coaxial tube 40 which has a bore 40' extending through the inflated seal 10. Said tube section 38' which has a comparatively large diameter and in a tightening manner grips around the piston rod 34*a*, is surrounded, like the rest of this tube 38, by longitudinal channels 24, 24' (alternatively by a concentric annulus) which, according to FIG. 4, are continued by a cylinder bore 42 extending downwards, the cylindrical bore 42 being continued with the same radius as that of a coaxial cylinder bore 44 of the lower cylindrical piston housing 27.

FIG. 5 shows a limit position for the piston rod/piston 34*a*/36 in said upper cylindrical housing.

In this embodiment in which are used two comparatively widely spaced, symmetrically placed, inflated downhole seals 10, the lower cylindrical piston housing 27 shown is provided, at a suitable point of its axial length, with mainly radially directed ports 46, 46', the cylinder bore 44 immediately below the ports 46, 46' being provided with a radially inward annular flange with a seal 48 tightening around the tubular piston rod 34*a*.

The lower conical, downward tapering end portion 27' of the lower cylindrical piston housing 27 is connected in a tight-fitting manner to a pipe (not shown), whose other end is connected to said second downhole seal (not shown) located there below, which, as already mentioned, is oriented mirror-symmetrically in relation to the shown seal 10 with the compensator 16. Thus, the two inflated downhole seals 10 are in such relative positions, that the free ends 27' of the compensators are facing each other. Thus a through-running, fluid-passing connection is established from below the not shown seal to above the shown seal, without any possibility of leakage to/from the space 50 between the seals.

When it is required always and in changing temperature conditions to maintain a safe internal pressure in the seals—not too high, not too low—the operation of the embodiment according to FIGS. 4 and 5 is exactly the same as that of the embodiment according to FIGS. 1–3, by the pressure from the well, respectively the seal 10, affecting the piston surfaces 36" and 36', respectively, so that the piston rod 34 is displaced in one direction or the other until the pressure has been equalized.

What is claimed is:

1. A sealing apparatus for use in a well in connection with oil or gas production, comprising:

a seal configured as an inflatable, balloon-type well seal, the seal having a first cavity and configured to bear against an inner surface of a tubular surface; and a pressure compensator associated with the seal and including a cylinder having a second cavity in fluid communication with the first cavity, the cylinder having a reciprocatingly slidable piston positioned therein, the piston having first and second piston surfaces of different areas at opposite sides of the piston, the first piston surface being exposed to a first pressure value within the first cavity and the second piston surface being exposed to a second pressure value within the well, the pressure compensator being configured to regulate, depending on a difference in the areas of the first and second piston surfaces, the first pressure value within the first cavity of the inflated well seal depending on the second pressure value effective downstream of the seal, the second pressure value constituting a reference pressure value for the first cavity of the seal.

2. The apparatus of claim 1, wherein the pressure compensator comprises a hollow body having a chamber of variable volume and in fluid communication with the first cavity, the chamber being defined by inner surfaces of the hollow body and the first piston surface, and wherein the surface area of the first piston surface is sized relative to the surface area of the second piston surface so that the desired pressure of the inflated seal is made dependent on the pressure in the surroundings in accordance with the same ratio.

3. The apparatus of claim 2, wherein the pressure compensator comprises a cylindrical hollow body having longitudinally extending cylinder bore sections, a first cylinder bore section is located nearest to the seal and has a first cross-section and a second cylinder bore section is located further from the seal and has a second cross-section, the first cross-section being smaller than the second cross-section, wherein the piston comprises a first piston portion and a second piston portion, the first piston portion being displaceably located within the first cylinder bore section and the second piston portion being displaceably located within the second cylinder bore section, the first and second piston portions being connected by means of a centric piston rod, the first piston.

4. The apparatus of claim 3, wherein the hollow body of the pressure compensator has an outer end, which is conically tapered and has a central, axial through hole providing for a communication between an interior of the hollow body and the well, the interior being defined in axial direction by said second piston surface.

5. The apparatus of claim 4, wherein the piston rod comprises an annular section, extending radially outward from the piston rod and having opposite section surfaces extending perpendicular to the axis of the hollow body and sized to have different surface areas; and wherein an axially directed fluid communication exists through the seal and the outer end of the pressure compensator.

6. The apparatus of claim 5, wherein the hollow body comprises at least one through port located upstream of an annular seal extending radially inward and sealingly surrounding the piston rod.

* * * * *